United States Patent [19]

Camillo et al.

[11] Patent Number: 4,817,796

[45] Date of Patent: Apr. 4, 1989

[54] PACKING BOX

[75] Inventors: David B. Camillo, Great Bend; Melvin Gentry, Lawrence, both of Kans.

[73] Assignee: Essex Group, Inc., Fort Wayne, Ind.

[21] Appl. No.: 164,318

[22] Filed: Mar. 4, 1988

[51] Int. Cl.[4] ..... B65D 85/04

[52] U.S. Cl. ..... 206/396; 206/395; 206/408; 229/157; 242/171

[58] Field of Search ..... 206/389, 395–397, 206/408, 409; 229/127, 130, 155–157; 242/137.1, 163, 170–172

[56] References Cited

U.S. PATENT DOCUMENTS

| | | | |
|---|---|---|---|
| 1,063,646 | 6/1913 | Bournonville | 242/171 |
| 1,889,933 | 12/1932 | Pratt | 229/157 |
| 2,779,527 | 1/1957 | Fallert | 229/157 |
| 2,860,773 | 11/1958 | Zackheim | 206/408 |
| 3,330,467 | 7/1967 | Johnson | 229/157 |
| 3,677,491 | 7/1972 | Gerwig | 242/163 |
| 3,877,661 | 4/1975 | Newman | 242/163 |
| 3,923,270 | 12/1975 | Newman et al. | 242/163 |
| 4,019,636 | 4/1977 | Wise | 206/396 |
| 4,022,399 | 5/1977 | Zajac | 242/163 |
| 4,057,203 | 11/1977 | Newman et al. | 242/163 |
| 4,057,204 | 11/1977 | Zajac | 242/163 |
| 4,160,533 | 7/1979 | Kotzur et al. | 242/137.1 |
| 4,274,607 | 6/1981 | Priest | 242/163 |
| 4,582,198 | 4/1986 | Ditton | 206/395 |

FOREIGN PATENT DOCUMENTS

| | | | |
|---|---|---|---|
| 0404114 | 1/1934 | United Kingdom | 206/395 |

*Primary Examiner*—Jimmy G. Foster
*Attorney, Agent, or Firm*—Lloyd D. Doigan

[57] ABSTRACT

A wire dispensing and storage box is provided with a plurality of flap tabs appending to the top and bottom portions of the box which are inserted within a plurality of flap slots within the side portions of the box, respectively, so that the top and bottom portions of the box will not interfere with the paying off of the wire from the coil. The flap slot/flap tab construction helps prevent the cones, which provide integrity to the box and help support the wire therein, and locking tabs, which lock the box, of the top of the box and the cones and locking tabs of the bottom of the box from contacting each other in the center of the box thereby facilitating the dispensing of the wire.

5 Claims, 4 Drawing Sheets

PACKING BOX

DESCRIPTION

1. Technical Field

This invention relates to an improved box for transporting, storing and dispensing wire.

2. Background Art

Wire shipping and dispensing boxes are well known. The boxes are typically constructed of corrugated cardboard and hold a preformed coil of wire. The preformed wire coil typically pays out from its center. A tube passes from the center of the coil through a side thereof to provide a conduit for dispensing the wire. The boxes generally have an opening cooperating with the tube so that the wire may be dispensed outside the box. The top portions of the box and the bottom portions of the box each have a pair of cones, which protrude into the box to center the coil therein and help keep the box closed, and a pair locking tabs, which secure the cones within the box.

Prior art boxes typically do not have the strength to resist crushing when the boxes are stacked on top of one another. If a box is crushed, the locking tabs and cones of the top of the box may contact the cones and locking tabs of the bottom of the box thereby preventing the wire from paying off the coil. Prior art boxes have several other typically undesirable traits: they do not stack in a stable manner; they do not maintain their integrity while dispensing the wire; they do not readily provide a means to determine how much wire is left in the coil; and, they may open during shipping. Some prior art boxes must be stapled to avoid opening during shipping. Such boxes risk having the staples interfere with the paying out of the wire.

An improved wire shipping and dispensing package is sought.

DISCLOSURE OF THE INVENTION

It is an object of the invention to provide a box which will support the weight of other items stacked thereupon without interfering with the dispensing of the wire from the box.

It is a further object of the invention to provide a box that will hold other boxes stacked thereupon in a stable manner.

It is a further object of the invention to provide a box that does not come apart during shipping.

It is a further object of the invention to provide a reliable and easy-to-use means to determine the amount of coil left in the box.

According to the invention, the box is provided with a plurality of flap tabs appending to the top and bottom portions of the box which are inserted within a plurality of flap slots within the side portions of the box, respectively, so that the top and bottom portions of the box will not interfere with the paying off of the wire from the coil. The flap slot/flap tab construction helps prevent the cones and locking tabs of the top of the box and the cones and locking tabs of the bottom of the box from contacting each other in the center of the box thereby facilitating the paying off of the wire from the coil.

According to a feature of the invention, alternate sides of the box have offset fold lines such that the box will fold in a square manner thereby preventing rounded box edges which may lead to instability when stacking the box.

According to a further feature of the invention, a tube hole is provided within a side of the box which is less prone to tearing when dispensing wire.

According to another feature of the invention the box is provided with locking means to prevent the box from opening during shipping.

According to a further feature of the invention an improved observation hole is provided to determine the amount of wire left in the coil.

These and other objects, features and advantages of the present invention will become more apparent in light of the following detailed description of a best mode embodiment thereof, as illustrated in the accompanying drawing.

BEST MODE FOR CARRYING OUT THE INVENTION

Figure 1:
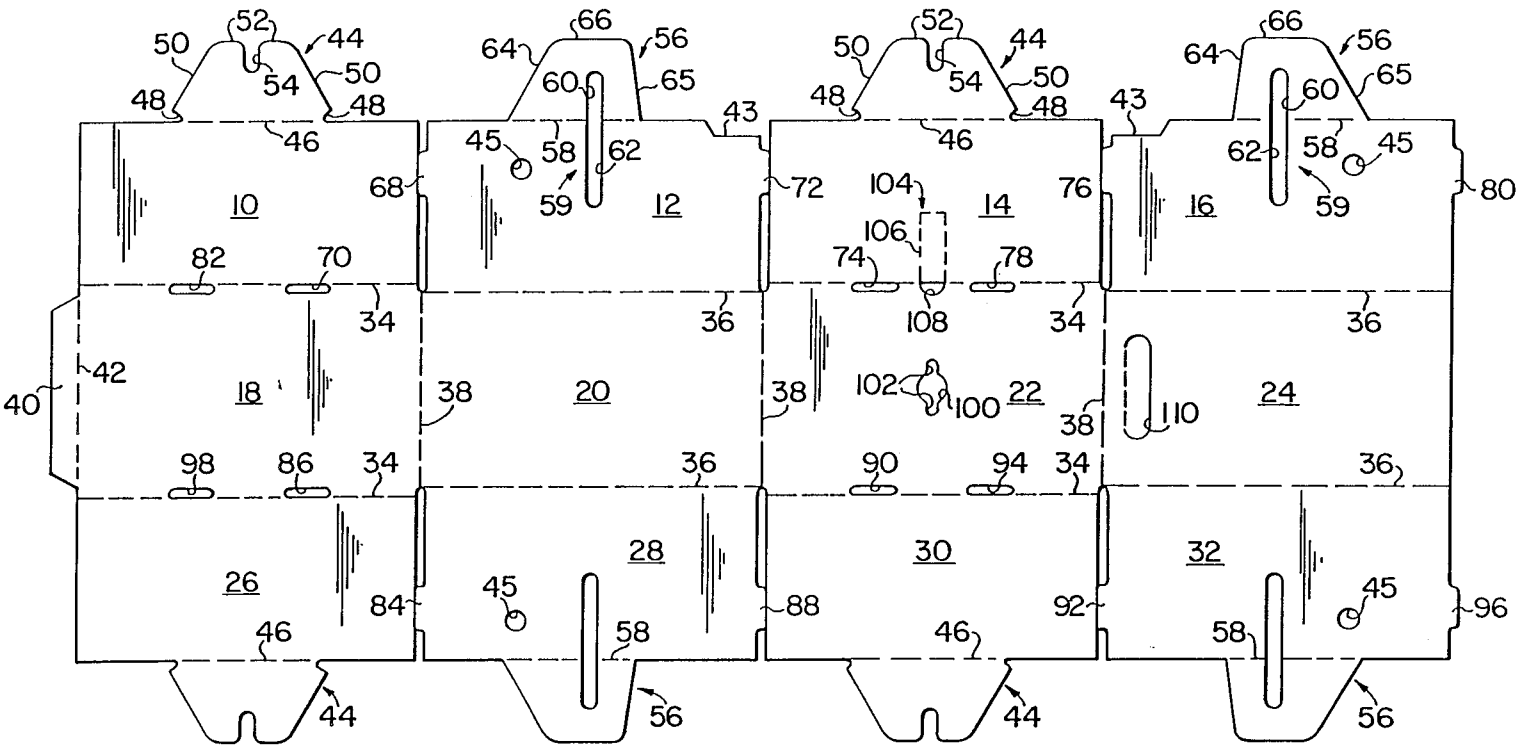
FIG. 1 is a plan view of a box, before the assembly thereof, which incorporates the features of the invention.
Figure 2:
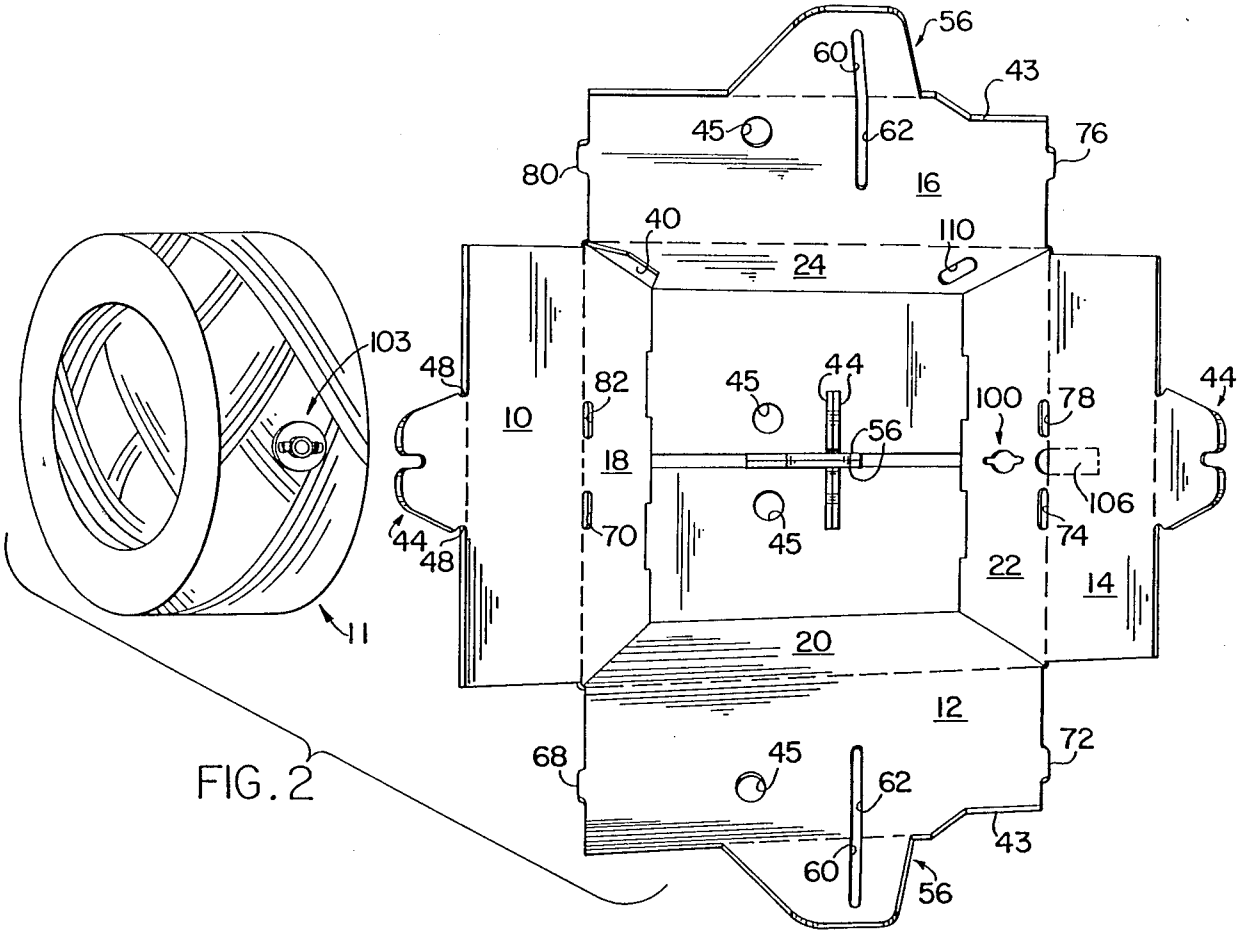
FIG. 2 shows an exploded top view of a partially assembled box of FIG. 1 and a coil of wire which is designed for insertion therein.

Referring to FIG. 1 and FIG. 2, an embodiment of the box of the invention is shown. FIG. 1 shows the box before the assembly thereof. FIG. 2 shows a partially assembled box and a coil of wire 11 which is designed for insertion therein. The box is comprised of a plurality of top sections (10, 12, 14, 16), a plurality of side portions (18, 20, 22, 24), and a plurality of bottom portions (26, 28, 30, and 32 . The respective top and bottom portions are cut apart to allow assembly of the box which will be described infra. The top and bottom portions are connected to the side portions along fold lines 34 and 36. Fold lines 34 are offset from fold line 36 by one thickness of corrugation as will be discussed infra. The side portions are connected by fold lines 38. Fold line 42 separates the side portion 18 and an attachment flap 40. Top sections 12 and 16 each have a cut out section 43 to determine the amount of wire left in the coil as will be discussed infra. Top sections 12 and 16 and bottom sections 28 and 32 each have a circular cutout portion 45 for use in assembling the box as will be discussed infra.

Top portions 10 and 14 and bottom portions 26 and 30 each have a cone 44 attached thereto by fold line 46. Each cone portion has a pair of locking indents 48, a pair of side portions 50 extending at an angle of about 65° from the respective top or bottom portion, a rounded top portion 52 and a locking slot 54. The angle of the side portions is designed to allow the wire to pay off the coil without snagging, tangling or winding about the cone.

Top portions 12 and 16 and bottom portions 28 and 32 each have a locking tab 56 attached thereto by a fold line 58. A slot 59, which is usually two corrugations wide, passes through the locking tab and the respective side or bottom portion. The slot has a locking portion 60 disposed through the locking tab for cooperating with the locking slot 54 in the cone 44 and a cone portion 62 disposed through the side portions for receiving the cone during assembly of the box as will be discussed infra. The locking tab 56 has a first side portion 64 extending at about the same angle as the side portion 50 of the cone, a second side portion 65 having a somewhat steeper angle than the side portion of the cone, and a top portion 66.

Top portions 12 and 16 and bottom portions 28 and 32 all have a pair of flap tabs which are designed to be inserted in flap slots in the side portions !8 and 22. Flap tab 68 is designed to be inserted in flap slot 70. Flap tab 72 is designed to be inserted in flap slot 74, and flap tab 76 is designed to be inserted in flap slot 78, flap tab 80 is designed to be inserted in flap slot 82. Similarly, flap tab 84 is designed to be inserted in flap slot 86. Flap tab 88 is designed to be inserted in flap slot 90. Flap tab 92 is designed to be inserted in flap slot 94, flap tab 96 is designed to be inserted in flap slot 98. By providing the box with the flap tabs and slots the box is provided with additional structural stiffness and integrity, so that the box may bear the weight of stacking without interfering with paying out of the wire from the coil as will be discussed infra.

Figure 6:
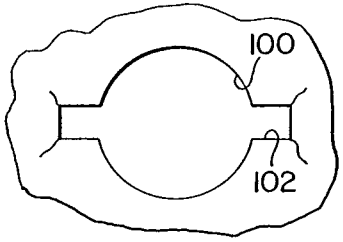
FIG. 6 PRIOR ART
FIG. 6 shows a prior art view of a portion of the box which cooperates with a pay out tube of the coil of wire.
Figure 5:
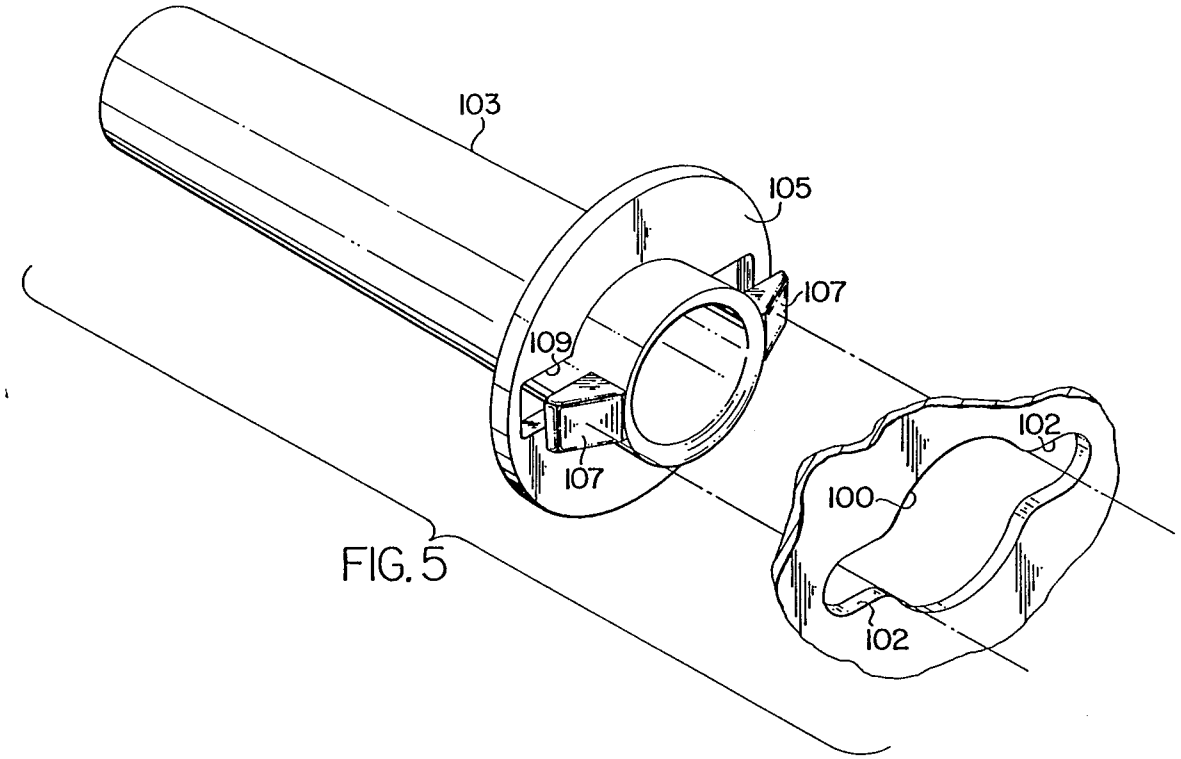
FIG. 5 shows a partially cut away portion of the box of FIG. 1.

The side portion 22 has a circular tube hole 100 and a pair of flutes 102 extending therethrough. The flutes are cut out from the box in the same direction as the corrugations of the box. The hole is designed to cooperate with a tube 103 (see FIGS. 2 and 5) that protrudes through the wire coil for dispensing the wire therefrom. The tube has a flat circular portion 105 arranged therearound which is larger than the diameter of the hole 100 so that the tube may not extend outside the box. Attached to the plate is a pair of wing like appendages 107 which are designed to pass through the flutes 102. Rotation of the wings locks the circular portion of the dispensing tube against the side portion 22 of the box so that the box may dispense the wire from the coil. Each appendage has an inner cam surface to help rotate the appendages against the side of the box and to provide a lock against reverse rotation. The portions 102 are rounded to prevent the appendages from grabbing the cardboard and tearing it. The prior art, as shown in FIG. 6, utilizes square corners which are subject to tears when the box is formed and when the appendages are rotated to lock the tube against the side of the box. Because tears within the hole 100 and the flutes are minimized, the integrity of the box is enhanced throughout the box's useful life.

Top portion 14 cooperates with the side portion 22 to create a viewing hole 104. The side portion 14 has an almost fully cutout rectangular portion 106. The side portion 22 has a semi-circular cutout portion 108. Side portion 24 has a handle flap 110 installed therein for ease in handling the box.

Figure 4:
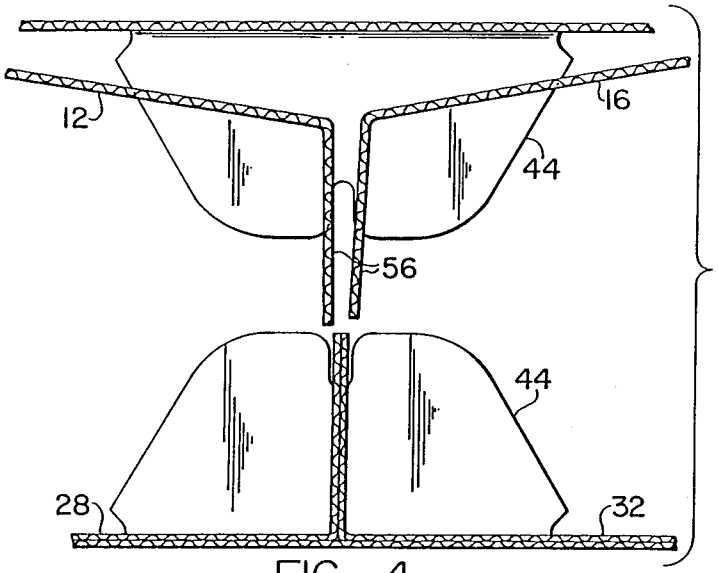
FIG. 4 shows a partially cut away side portion of the box of FIG. 1.
Figure 3:
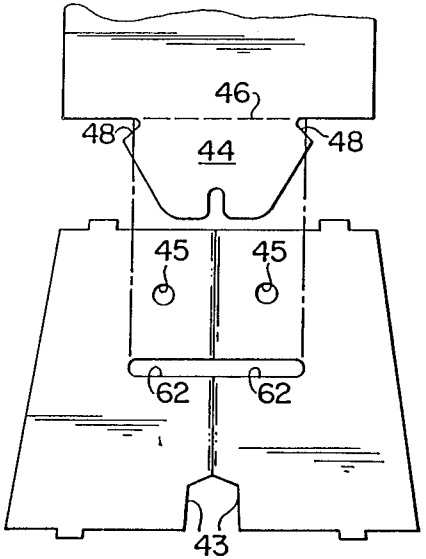
FIG. 3 shows a perspective view of a portion of the construction of the box of FIG. 1.

In order to assemble the box, the fold lines 38 and 42 are folded at 90° angles so that the attachment flap 40 contacts the side portion 24. The attachment flap 40 is then attached to the side portion 24 by any known means such as glue or staples. At this point, the cone portions 44 are bent towards each other at 90° along line 46 and locking tabs 56 are bent towards each other at 90° along lines 58. Sides 28 and 32 are then also bent at 90° along line 36 towards each other. The slots 62 in section 28 and 32 essentially abut each other to form an elongated slot (see FIG. 3). Tab 88 fits in slot 90. Tab 84 fits in slot 86. Tab 92 fits in slot 94 and tab 96 fits in slot 98. At this point, the bottom portions 30 and 26 are bent towards each other. The already bent cones fit within the elongated slot (see FIG. 3). If the cones force the top or bottom sections 12, 16, 28, or 32 inwardly (see FIG. 4 which shows the top portions 12 and 16 forced into the box), forcing the flap tabs from the flap slots, an operator may pull the top or bottom sections back to the proper position by inserting an appendage into the holes 45 and pulling the top or bottom portions into the proper position. The locking slot 54 in the cones slides along the locking portion 60 of the slot of the locking tab to engage the locking tab 56 thereby protecting the integrity of the box. The cones are wider than the elongated slot (see FIG. 3) so that the locking indent engages the edges of the cone portion of the slot thereby preventing the cone from coming out of the slot.

At this point, the coil of wire 11 is inserted into the box. The plate of the tube 105 abuts tube hole 100 and the appendages 107 are inserted through the flutes 102 and rotated to lock the tube against the tube hole. The tube is further aligned so that the second side portion 65 of the locking tab faces the hole 100. If the slope of the second side of the locking tab is the same as the first side 64 of the locking tab, the locking tab would interfere with the dispensing of the wire through the tube.

Assembly of the top of the box continues after the insertion of the coil in a similar manner to the bottom of the box. The cones are bent at 90 along the fold lines 46, the locking tabs are folded along the fold lines 58. The portion 12 and 16 are bent at 90° towards each other wherein the flap tab 80 engages the lock slot 82, the flap tab 68 engages the flap slot 70, the flap tab 72 engages the flap slot 74 and the flap tab 76 engages the flap slot 78. At this point, sections 10 and 14 are bent towards each other at 90° such that cone portions 44 extend through the elongated slot formed between the cone portions of section 12 and 16. The locking slot of the cones slide up the locking portion of the locking tab until they engage the locking tab thereby closing the box.

The offset fold lines 34 and 36 allow the portions 10 and 14, 26 and 30 to fold upon sections 12 and 16, 28, 32 without any rounded corners. This feature provides for a more rectangular box. In the prior art without the offset lines a rounded corner wound ensue when the sections 14, 10, 26 and 30 were folded upon 12, 16, 28 and 32, respectively. Such rounded corners were not conducive to being able to stack the boxes in a stable manner.

In order to view the amount of wire left in the coil, an operator may insert an appendage within cutout portion 108 to remove the portion 106 to provide a view of the top of the coil to see how many windings are left therein. An operator may directly view the coil because the portion 106 aligns with the cutout portions 43 of the top sections 12 and 16. Because the portion 106 is defined by a number of long cuts through the top section 14, removal of the portion is easily accomplished.

Although the invention has been shown and described with respect to a best mode embodiment thereof, it should be understood by those skilled in the art that the foregoing and various other changes, omissions, and additions in the form and detail thereof maybe made therein without departing from the spirit and scope of the invention.

We claim:

1. A box for dispensing and storing wire or the like, said box having a hole and a plurality of flutes for dispensing the wire, a plurality of side portions, two pairs of folding bottom portions, one of each of said pairs being appended to a bottom of one of said side portions, each of one pair being appended to a respective bottom portion by a first fold line and each of the other pair being appended to a respective bottom portion by a second fold line, and two pairs of folding top portions, one of each of said pairs being appended to a top of one of said side portions, each of one pair being appended to a respective top portion by a first fold line and each of the other pair being appended to a respective top portion by a second fold line, one pair of said top portions and one pair of said bottom portions having cones appending thereto, and the other pair of said top portions and the other pair of said bottom portions having locking tabs appending thereto, said cones being inserted through a slot formed within said box and being anchored therein by said locking tabs, wherein the improvement is characterized by;

each of said pairs of top portions and each of said pairs of bottom portions having said locking tabs appended thereto having a flap tab appended on both sides thereof, and each of said side portions appended to said top and bottom portions having cones appended thereto having a plurality of slots passing therethrough for engaging said flap tabs such that said cones and locking tabs of said pairs of top portions do not touch said cones and locking tabs of said pairs of bottom portions.

2. The box of claim 1 wherein the improvement is further characterized by;

each of said cones being wider than said slot and having a pair of indented portions to engage edges of said slot such that upon insertion of each of said cones within said slot said cones do not disengage from said slot thereby minimizing the probability that said box will open.

3. The box of claim 1 wherein the improvement is further characterized by;

means for viewing the amount of wire left within said box comprising a first cutout portion in an upper portion of a side portion, a second cutout portion in at least one of said top or bottom portion which has a locking tab appended thereto, and a perforated section abutting said second cutout portion and disposed within a top or bottom portion which has a cone appended thereto, said first cutout portion being adapted to allow for the removal of said perforated section, and said perforated section and said second cutout portion aligning such that upon removal of said perforated section, said wire may be observed through said first cutout portion.

4. The box of claim 1 wherein the improvement is further characterized by;

said first fold line is offset from said second fold line by a thickness of either a top or bottom portion of said box such that during assembly of the box if one of said pairs of said top or bottom portions is folded upon the other of said pairs of said top or bottom portions, a square corner of said box results.

5. The box of claim 1 wherein the improvement is further characterized by;

said flutes having rounded corners such that said flutes are not torn during construction of the box or during dispensing of said wire.

* * * * *